US008900034B2

(12) United States Patent
Kumeno et al.

(10) Patent No.: US 8,900,034 B2
(45) Date of Patent: Dec. 2, 2014

(54) MACHINE TOOL AND MACHINING METHOD

(75) Inventors: Toshiki Kumeno, Kyoto (JP); Masashi Yoritsune, Anjo (JP); Takashi Matsumoto, Kariya (JP); Kazuyoshi Ohtsubo, Chiryu (JP)

(73) Assignee: JTEKT Corporation, Osaka-shi (JP)

( * ) Notice: Subject to any disclaimer, the term of this patent is extended or adjusted under 35 U.S.C. 154(b) by 446 days.

(21) Appl. No.: 13/394,352

(22) PCT Filed: Sep. 10, 2010

(86) PCT No.: PCT/JP2010/065651

§ 371 (c)(1),
(2), (4) Date: Mar. 6, 2012

(87) PCT Pub. No.: WO2011/030866

PCT Pub. Date: Mar. 17, 2011

(65) Prior Publication Data

US 2012/0164920 A1 Jun. 28, 2012

(30) Foreign Application Priority Data

Sep. 11, 2009 (JP) ..... 2009-210113

(51) Int. Cl.

| | |
|---|---|
| ***B24B 49/00*** | (2012.01) |
| ***B24B 5/04*** | (2006.01) |
| ***B24B 5/42*** | (2006.01) |
| ***B24B 19/12*** | (2006.01) |

(52) U.S. Cl.

CPC . *B24B 5/04* (2013.01); *B24B 49/00* (2013.01); *B24B 5/42* (2013.01); *B24B 19/125* (2013.01)

USPC ..... 451/11; 451/142; 451/143; 451/150

(58) Field of Classification Search

CPC ..... B24B 5/04; B24B 5/042; B24B 19/12; B24B 19/125

USPC ..... 451/5, 11, 49, 51, 130, 131, 136, 142, 451/143, 150

See application file for complete search history.

(56) References Cited

U.S. PATENT DOCUMENTS 2,802,312 A * 8/1957 Grove et al. ..... 451/26
2,984,952 A * 5/1961 Gebel ..... 451/24

(Continued)

FOREIGN PATENT DOCUMENTS

JP 7 214466 8/1995
JP 8 168957 7/1996

(Continued)

OTHER PUBLICATIONS

International Search Report Issued Nov. 30, 2010 in PCT/JP10/65651 Filed Sep. 10, 2010.

(Continued)

*Primary Examiner* — Maurina Rachuba

(74) *Attorney, Agent, or Firm* — Oblon, Spivak, McClelland, Maier & Neustadt, L.L.P.

(57) ABSTRACT

A control unit that relatively moves a headstock and tailstock and a tool to thereby machine a peripheral surface of a workpiece in a radial direction executes control such that a relative feed speed of the tool in the radial direction in a transitional state where an amount of warpage of the workpiece in the radial direction at a machining position increases is faster than a relative feed speed of the tool in the radial direction in a steady state where an amount of warpage of the workpiece in the radial direction at the machining position is constant. By so doing, it is possible to reduce a machining time at the time of the start of machining.

7 Claims, 4 Drawing Sheets

(56) References Cited

U.S. PATENT DOCUMENTS

| | | | | |
|---|---|---|---|---|
| 3,247,620 | A * | 4/1966 | Happel | 451/249 |
| 3,748,789 | A * | 7/1973 | Wada et al. | 451/14 |
| 3,863,400 | A * | 2/1975 | Rossi | 451/5 |
| 3,934,376 | A | 1/1976 | Tamesui et al. | |
| 4,118,900 | A | 10/1978 | Moritomo et al. | |
| 4,187,646 | A | 2/1980 | Smith et al. | |
| 5,746,643 | A | 5/1998 | Terasaki et al. | |
| 8,517,797 | B2 * | 8/2013 | Kumeno et al. | 451/5 |
| 2004/0166776 | A1 * | 8/2004 | Kondo et al. | 451/28 |
| 2011/0097971 | A1 | 4/2011 | Kumeno et al. | |

FOREIGN PATENT DOCUMENTS

| | | | |
|---|---|---|---|
| JP | 2000 263437 | | 9/2000 |
| JP | 2002-292560 | A | 10/2002 |
| JP | 2003 275957 | | 9/2003 |
| JP | 2004-114195 | A | 4/2004 |
| JP | 2009-180105 | A | 8/2009 |

OTHER PUBLICATIONS

European Search Report, Aug. 5, 2014, Application No. 10815460.0—1702/2476513.

* cited by examiner

MACHINE TOOL AND MACHINING METHOD

TECHNICAL FIELD

The invention relates to a machine tool that radially machines the peripheral surface of a workpiece and its machining method.

BACKGROUND ART

Conventionally, there is a grinding machine described in Japanese Patent Application Publication No. 7-214466 (Patent Document 1) as a machine tool that radially cuts into the outer peripheral surface of a cylindrical workpiece. The grinding machine feeds a wheel head forward at a constant feed speed at the time of machining.

RELATED ART DOCUMENT

Patent Document

Patent Document 1: Japanese Patent Application Publication No. 7-214466

SUMMARY OF THE INVENTION

Problems to be Solved by the Invention

Incidentally, generally, in each of rough machining, finish machining, and the like, an appropriate feed speed of a tool is set in terms of machining accuracy, machining burn (grinding burn), and the like. However, at the time of the transition from a state where a tool is not in contact with a workpiece (idle machining) to actual machining, that is, at the time of the start of machining, force pressing the tool against the workpiece suddenly acts, so the workpiece radially warps. That is, the workpiece is machined by the tool while being radially warped. Therefore, it has been found that, in this state, the relative feed speed between the tool and the workpiece has not reached a target feed speed, leading to a long machining time.

The invention is contemplated in light of the above situation, and it is an object of the invention to provide a machine tool and machining method that are able to reduce a machining time at the time of the start of machining.

Means for Solving the Problems

In order to solve the above problem, the invention of a machine tool according to claim 1 includes: supporting means that rotatably supports a shaft-like workpiece; a tool that is relatively movable in a radial direction of the workpiece with respect to the supporting means; and control means that relatively moves the supporting means and the tool to machine a peripheral surface of the workpiece in the radial direction, wherein the control means executes control such that a relative feed speed of the tool in the radial direction in a transitional state where an amount of warpage of the workpiece in the radial direction at a machining position increases is faster than a relative feed speed of the tool in the radial direction in a steady state where an amount of warpage of the workpiece in the radial direction at the machining position is constant.

The invention according to claim 2 is such that the transitional state is a state immediately after a transition from idle machining to machining.

The invention according to claim 3 is such that the machine tool further includes: machining resistance detecting means that detects a machining resistance that occurs at the time when the workpiece is machined by the tool in actual machining; and target machining resistance setting means that, when the workpiece of the same type has been machined before, sets the machining resistance in a steady state where the amount of warpage of the workpiece in the radial direction is constant as a steady target machining resistance, wherein, in the transitional state, the control means controls the feed speed of the tool in the radial direction such that the current machining resistance reaches the target machining resistance.

The invention according to claim 4 is such that the control means varies the feed speed of the tool in the radial direction in response to the current machining resistance in the transitional state.

The invention according to claim 5 is such that the machine tool further includes machining diameter measuring means that measures a machining diameter of the workpiece, wherein, at the time of machining the workpiece, the target machining resistance setting means corrects the steady target machining resistance on the basis of the machining diameter of the workpiece, measured by the machining diameter measuring means.

The invention according to claim 6 is such that, when the steady target machining resistance is set, the target machining resistance setting means sets an amount of reduction per unit time of the machining diameter of the workpiece in the steady state, calculated by the machining diameter measuring means in advance, when the current workpiece is machined, the target machining resistance setting means uses the machining diameter measuring means to calculate a current amount of reduction per unit time of the machining diameter of the workpiece in the steady state, the target machining resistance setting means multiplies a value, obtained by dividing the current amount of reduction per unit time of the machining diameter by the set amount of reduction per unit time of the machining diameter, by the steady target machining resistance, and the target machining resistance setting means sets the obtained value as the new steady target machining resistance.

The invention of a machining method according to claim 7 for relatively moving a shaft-like workpiece and a tool in a radial direction of the workpiece while rotating the workpiece to thereby machine a peripheral surface of the workpiece in the radial direction includes executing control such that a relative feed speed of the tool in the radial direction in a transitional state where an amount of warpage of the workpiece in the radial direction at a machining position increases is faster than a relative feed speed of the tool in the radial direction in a steady state where an amount of warpage of the workpiece in the radial direction at the machining position is constant.

Note that the above described inventions of the machine tools according to claim 2 to 6 may be substantially directly applied to the invention of the machining method according to claim 7.

Advantageous Effects of the Invention

With the thus configured invention according to claim 1, the feed speed of the tool in the radial direction (hereinafter, referred to as "relative feed speed of the tool") with respect to the workpiece in the transitional state is controlled so as to be faster than the relative feed speed of the tool in the steady state. Here, the transitional state corresponds to a state where the amount of warpage of the workpiece in the radial direction at the machining position increases, that is, a state immediately after a transition from idle machining to rough machining. On the other hand, the steady state corresponds to a state where the amount of warpage of the workpiece in the radial direction at the machining position is constant, that is, a state where a certain period of time has elapsed after the start of rough machining. That is, immediately after the start of rough machining, the relative feed speed of the tool is controlled so as to be faster than the target value (which corresponds to the feed speed in the steady state) to thereby make it possible to reduce a machining time in the transitional state. Here, in the above description, rough machining is described as an example; however, as long as the amount of warpage of the workpiece in the radial direction increases in the transitional state, it may also be similarly applied to finish machining.

With the invention according to claim 2, the transitional state is clarified. That is, the relative feed speed of the tool immediately after a transition from idle machining to machining is controlled so as to be faster than the relative feed speed of the tool in the steady state thereafter.

With the invention according to claim 3, the machining resistance in the steady state at the time when a workpiece of the same type has been machined before is set as the steady target machining resistance, and the machining resistance of the currently machining workpiece in the transitional state is subjected to control so as to reach the steady target machining resistance. That is, information at the time of the previous machining is utilized. Here, the steady state is a state where the machining resistance is constant as described above. That is, by the time when the machining resistance in the steady state is reached, it is presumable that there is no problem in terms of machining accuracy and machining burn. Thus, in the currently machining transitional state, the relative feed speed of the tool is controlled so as to reach the steady target machining resistance to thereby make it possible to suppress occurrence of a problem of machining accuracy or machining burn. Then, by setting the target value of the machining resistance, it is possible to execute feedback control using the machining resistance.

With the invention according to claim 4, in the transitional state, the relative feed speed of the tool is not constant but appropriately varied. As the relative feed speed of the tool is steeply varied in the last period of the transitional state, that is, around the point of transition from the transitional state to the steady state, there is a possibility that the actual machining resistance exceeds the steady target machining resistance. Then, in some cases, there is a possibility that a problem of machining accuracy or machining burn occurs. Then, for example, the relative feed speed of the tool is controlled so as to be fast in a period from the initial period to the middle of the transitional state, and the relative feed speed of the tool is controlled so as to gradually decrease around the last period of the transitional state. That is, at the time of the transition from the transitional state to the steady state, it is possible to suppress a steep variation in the relative feed speed of the tool. As a result, it is possible to suppress occurrence of a problem of machining accuracy or machining burn.

Here, in machining in the steady state, for example, the machining resistance may vary because of a variation in sharpness of a tool (grinding wheel, or the like), or the like. Then, even when an actual machining resistance in the steady state coincides with the already set steady target machining resistance, an actual amount of cutting becomes smaller than a target amount of cutting. Then, in such a case, with the invention according to claim 5, the steady target machining resistance may be corrected, so it is possible to set the steady target machining resistance appropriate for a current state. With the invention according to claim 6, a specific processing method regarding correction of the steady target machining resistance is specified. With these, it is possible to reliably set the appropriate steady target machining resistance. With the invention according to claim 7, it is possible to obtain the substantially equivalent advantageous effects to the advantageous effects of the invention of the machine tool according to claim 1. In addition, when the inventions regarding another machine tool are applied to the machining method, the same advantageous effects as the respective advantageous effects may be obtained.

EMBODIMENTS OF THE INVENTION

Hereinafter, a specific embodiment of a machine tool and machining method according to the invention will be described with reference to the drawings. By way of example, a wheel head traverse-type external cylindrical grinding machine will be described as an example of the machine tool according to the present embodiment. Then, a shaft-like workpiece, such as a camshaft and a crankshaft, is taken as an example of a target workpiece W to be machined by the grinding machine. However, a workpiece, other than the camshaft or the crankshaft, is also applicable as the workpiece W as long as it has a shaft-like shape.

Figure 1:
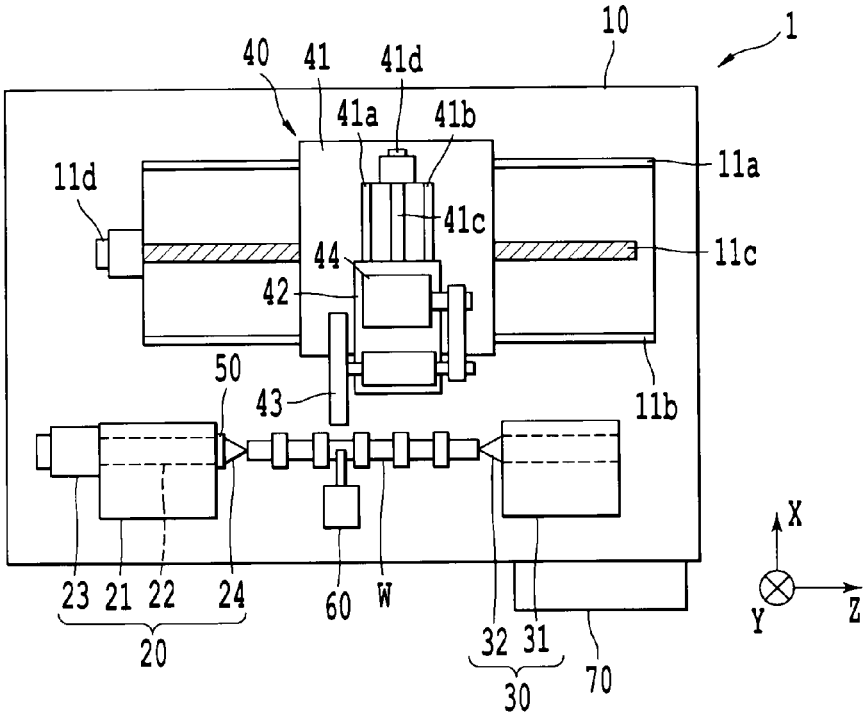
FIG. 1 shows a plan view of a machine tool.

The grinding machine will be described with reference to FIG. 1. As shown in FIG. 1, the grinding machine 1 is formed of a bed 10, a headstock 20, a tailstock 30, a grinding wheel support device 40, a force sensor 50, a sizing device 60 and a controller 70.

The bed 10 has substantially a rectangular shape and is arranged on a floor. A pair of wheel head guide rails 11*a* and 11*b* are formed on the upper surface of the bed 10 so as to extend in the horizontal direction (Z-axis direction) in FIG. 1 and are parallel to each other. The pair of wheel head guide rails 11*a* and 11*b* are rails over which a wheel head traverse base 41 that constitutes the grinding wheel support device 40 is slidable. Furthermore, on the bed 10, a wheel head Z-axis ball screw lie is arranged between the pair of wheel head guide rails 11*a* and 11*b* in order to drive the wheel head traverse base 41 in the horizontal direction in FIG. 1, and a wheel head Z-axis motor 11*d* that drives the wheel head Z-axis ball screw 11*c* for rotation is arranged.

The headstock 20 (which corresponds to "supporting means" according to the invention) includes a headstock body 21, a main spindle 22, a main spindle motor 23 and a main spindle center 24. The headstock body 21 is fixed to the lower left side in FIG. 1 on the upper surface of the bed 10. However, the Z-axis direction position of the headstock body 21 is slightly adjustable with respect to the bed 10. The main spindle 22 is inserted and supported in the headstock body 21 so as to be rotatable about its axis (about the Z axis in FIG. 1). The main spindle motor 23 is provided at the left end of the main spindle 22 in FIG. 1. The main spindle 22 is driven by the main spindle motor 23 for rotation with respect to the headstock body 21. The main spindle motor 23 has an encoder, and is able to detect the rotation angle of the main spindle motor 23 using the encoder. In addition, the main spindle center 24 that supports one axial end of the shaft-like workpiece W is connected to the right end of the main spindle 22.

The tailstock 30 (which corresponds to "supporting means" according to the invention) includes a tailstock body 31 and a tailstock spindle center 32. The tailstock body 31 is fixed to the lower right side in FIG. 1 on the upper surface of the bed 10. However, the Z-axis direction position of the tailstock body 31 is slightly adjustable with respect to the bed 10. The tailstock spindle center 32 is provided for the tailstock 31 so as to be non-rotatable with respect to the tailstock 31. The tailstock spindle center 32 is located along the same axis as the rotation axis of the main spindle 22.

Then, the tailstock spindle center 32 supports the other axial end of the workpiece W. That is, the tailstock spindle center 32 is arranged so as to face the main spindle center 24. Then, the main spindle center 24 and the tailstock spindle center 32 rotatably support both ends of the workpiece W. Furthermore, the tailstock spindle center 32 is able to change the amount of protrusion from the right end surface of the tailstock body 31. That is, the amount of protrusion of the tailstock spindle center 32 may be adjusted in response to the position of the workpiece W. In this way, the workpiece W is held by the main spindle center 24 and the tailstock spindle center 32 so as to be rotatable about the axis of the main spindle (about the Z axis).

The grinding wheel support device 40 includes the wheel head traverse base 41, the wheel head 42, a grinding wheel 43 (which corresponds to "tool" according to the invention) and a wheel rotating motor 44. The wheel head traverse base 41 is formed in a rectangular plate-like shape, and is arranged so as to be slidable over the pair of wheel head guide rails 11*a* and 11*b* on the upper surface of the bed 10. The wheel head traverse base 41 is coupled to a nut member of the wheel head Z-axis ball screw 11*c*, and is driven by the wheel head Z-axis motor 11*d* to move along the pair of wheel head guide rails 11*a* and 11*b*. The wheel head Z-axis motor 11*d* has an encoder, and is able to detect the rotation angle of the wheel head Z-axis motor 11*d* using the encoder.

A pair of X-axis guide rails 41*a* and 41*b* over which the wheel head 42 is slidable are formed on the upper surface of the wheel head traverse base 41 so as to extend in the vertical direction (X-axis direction) in FIG. 1 and are parallel to each other. Furthermore, on the wheel head traverse base 41, an X-axis ball screw 41*c* for driving the wheel head 42 in the vertical direction of FIG. 1 is arranged between the pair of X-axis guide rails 41*a* and 41*b*, and an X-axis motor 41*d* that drives the X-axis ball screw 41*c* for rotation is arranged. The X-axis motor 41*d* has an encoder, and is able to detect the rotation angle of the X-axis motor 41*d* using the encoder.

The wheel head 42 is arranged so as to be slidable over the pair of X-axis guide rails 41*a* and 41*b* on the upper surface of the wheel head traverse base 41. Then, the wheel head 42 is coupled to a nut member of the X-axis ball screw 41*c*, and is driven by the X-axis motor 41*d* to move along the pair of X-axis guide rails 41*a* and 41*b*. That is, the wheel head 42 is relatively movable in the X-axis direction (plunge feed direction) and the Z-axis direction (traverse feed direction) with respect to the bed 10, the headstock 20 and the tailstock 30.

Then, a hole that extends through in the horizontal direction of FIG. 1 is formed at the lower portion of the wheel head 42 in FIG. 1. A grinding wheel rotary shaft member (not shown) is supported in the through hole of the wheel head 42 so as to be rotatable about the wheel central axis and parallel to the Z axis. The disc-shaped grinding wheel 43 (which corresponds to "tool" according to the invention) is coaxially connected to one end (left end in FIG. 1) of the grinding wheel rotary shaft member. That is, the grinding wheel 43 is supported at one end by the wheel head 42. Specifically, the right end side of the grinding wheel 43 in FIG. 1 is supported by the wheel head 42, and the left end side of the grinding wheel 43 in FIG. 1 is a free end. In addition, the wheel rotating motor 44 is fixed to the upper surface of the wheel head 42. Then, a pulley is suspended at the other end (right end in FIG. 1) of the grinding wheel rotary shaft member and the rotary shaft of the wheel rotating motor 44, so the wheel rotating motor 44 is driven to rotate the grinding wheel 43 about the wheel spindle.

The force sensor 50 (which corresponds to "machining resistance detecting means" according to the invention) is provided for the main spindle 22, and measures X-axis direction component force applied to the main spindle 22. That is, the force sensor 50 detects a machining resistance that occurs as the workpiece W is machined by the grinding wheel 43. Here, in order to perform machining while moving the grinding wheel 43 only in the X direction with respect to the workpiece W, the force sensor 50 is configured to measure only the X-axis direction component force. A signal measured by the force sensor 50 is output to the controller 70. The sizing device 60 (which corresponds to "machining diameter measuring means" according to the invention) measures the outside diameter of the workpiece W at the machining position. A signal measured by the sizing device 60 is output to the controller 70.

The controller 70 (which corresponds to "control means" and "target resistance setting means" according to the invention) controls the motors to rotate the workpiece W about the main spindle, rotate the grinding wheel 43 and change the relative position of the grinding wheel 43 in the Z-axis direction and X-axis direction with respect to the workpiece W to thereby grind the outer peripheral surface of the workpiece W. The controller 70 executes position control on the basis of the positions detected by the encoders in one case and executes resistance control on the basis of the machining resistance detected by the force sensor 50 in the other case. The details will be described later.

Figure 2:
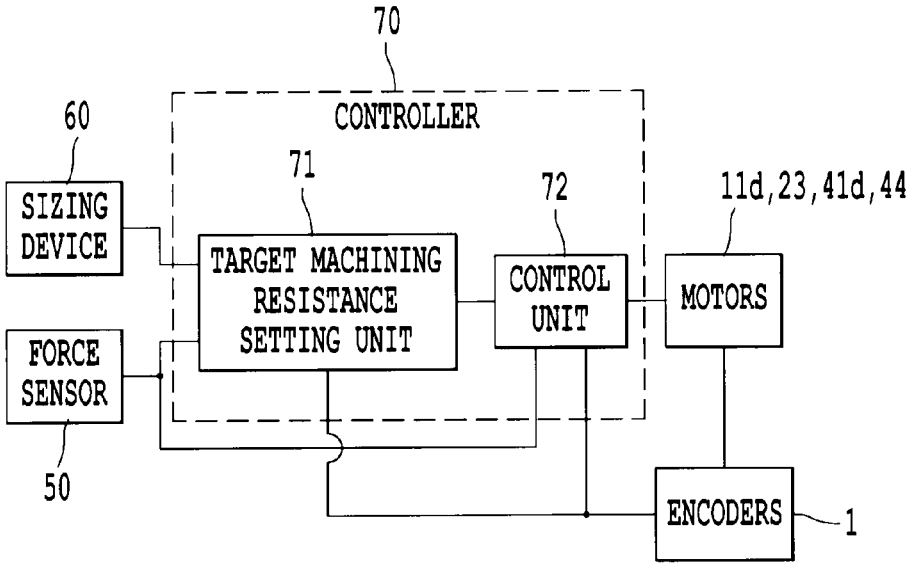
FIG. 2 is a functional block diagram of the machine tool.

Next, the function of the grinding machine 1 and a method of machining the workpiece W using the grinding machine 1 will be described with reference to FIG. 2. As shown in FIG. 2, the controller 70 is formed of a target machining resistance setting unit 71 and a control unit 72. The target machining resistance setting unit 71 (which corresponds to "target resistance setting means" according to the invention) sets a steady target machining resistance Rt in the case where resistance control is executed. The steady target machining resistance Rt is a target machining resistance in a steady state.

Here, the steady state is a state where the amount of warpage of the workpiece W in the radial direction is constant. A state in a period from the start of machining to when the steady state is reached is called a transitional state. In the transitional state, the amount of warpage of the workpiece W in the radial direction increases. The target machining resistance setting unit 71 initializes the steady target machining resistance Rt when an initial workpiece W is machined through position control. After that, where necessary, the target machining resistance setting unit 71 corrects the steady target machining resistance Rt. The target machining resistance setting unit 71 sets and corrects the steady target machining resistance Rt on the basis of information output from the encoders, the sizing device 60 and the force sensor 50.

The control unit 72 (which corresponds to "control means" according to the invention) executes position control over the motors 11*d* and 41*d* on the basis of information output from the encoders to thereby machine the outer peripheral surface of the workpiece W. In addition, the control unit 72 executes resistance control on the basis of the target machining resistances set in the target machining resistance setting unit 71 and information output from the force sensor 50 to thereby machine the outer peripheral surface of the workpiece W.

Hereinafter, the process executed by the controller 70 will be described in detail with reference to FIG. 3, FIG. 4A and FIG. 4B. First, the present embodiment is intended for the case where a plurality of workpieces W of the same type are successively machined. For the sake of convenience, the first workpiece W is termed initial workpiece W1, and the second and following workpieces Wn are termed following workpieces.

Figure 3:
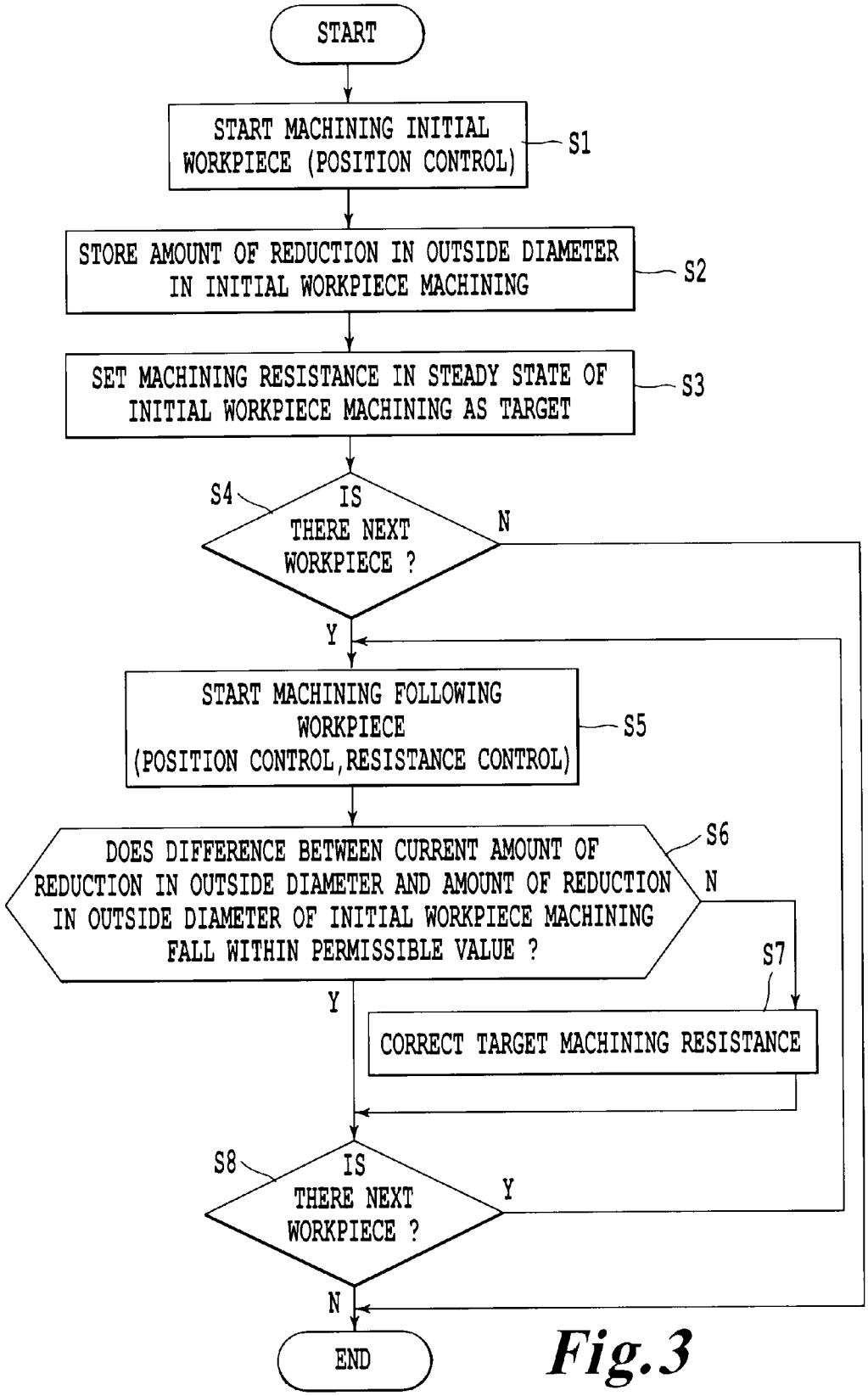
FIG. 3 is a flowchart that shows process executed by a controller.

As shown in FIG. 3, first, machining the initial workpiece W1 (hereinafter, referred to as "initial workpiece machining") is started (S1). In the initial workpiece machining, position control over the X-axis motor 41*d* is executed on the basis of a preset position command value and position information detected by the encoder to thereby machine the outer peripheral surface of the initial workpiece W1. That is, feedback control using the position is executed over the initial workpiece W1. Then, the feed speed of the grinding wheel 43 in the X-axis direction is controlled through position control for the initial workpiece W1. Here, at this time point, the steady target machining resistance Rt has not been set in the target machining resistance setting unit 71 yet.

Figure 4A:
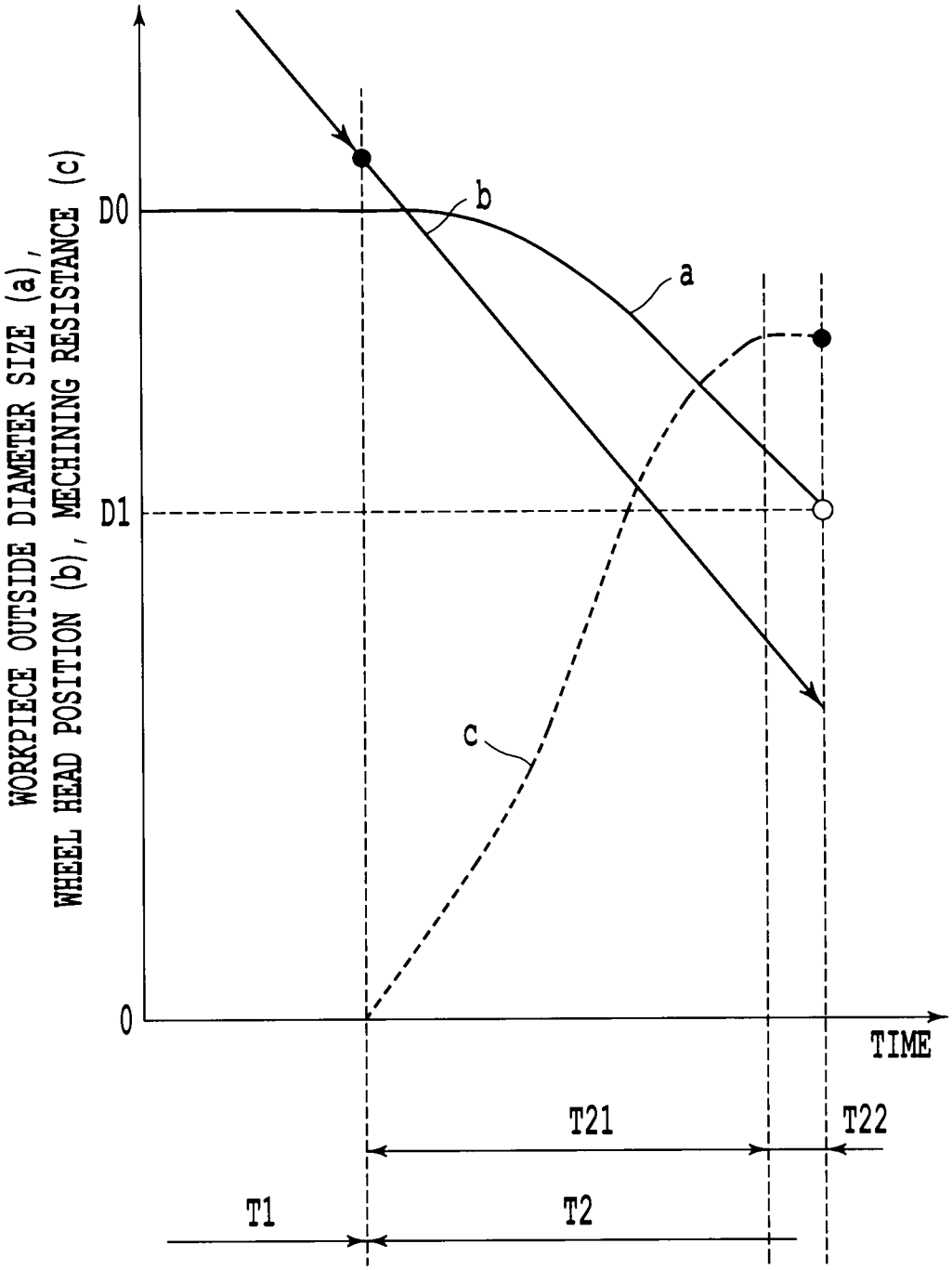
FIG. 4A is a graph that shows a workpiece outside diameter size, a wheel head position and a machining resistance in machining of an initial workpiece.

The workpiece outside diameter size a, the wheel head position b and the machining resistance c in the initial workpiece machining behave as shown in FIG. 4A. In FIG. 4B. T1 is a period in idle machining. T2 is a period in actual machining, T21 is a period in actual machining in the transitional state, and T22 is a period in actual machining in the steady state.

In the idle machining, the machining resistance is zero as indicated by c in FIG. 4A. In addition, the workpiece outer size at this time is D0 as indicated by a in FIG. 4A. In addition, the behavior of the wheel head position, that is, the feed speed of the grinding wheel 43, at this time has an inclination indicated by b in FIG. 4A.

As indicated by b in FIG. 4A, in the actual machining after the end of the idle machining, the feed speed of the grinding wheel 43 is the same as the feed speed during the idle machining. In the initial period in the actual machining, it is placed in the transitional state (period T21), and the machining resistance steeply increases. After that, it reaches the steady state (period T22) during which the machining resistance is constant.

Here, throughout the entire initial workpiece machining, the outside diameter reduction amount D1 of the initial workpiece W1 is stored (S2). The outside diameter reduction amount D1 of the initial workpiece W1 is measured by the sizing device 60. Specifically, the outside diameter reduction amount D1 per unit time in the steady state in the initial workpiece machining is measured.

Subsequently, the machining resistance in the steady state (period T22) of the initial workpiece machining is set as the steady target machining resistance Rt (S3). The set steady target machining resistance Rt is stored in the target machining resistance setting unit 71.

Subsequently, it is determined whether there is the next workpiece W (S4). Then, when there is no next workpiece W (N in S4), the process ends. On the other hand, when there is the next workpiece W, that is, the following workpiece Wn (Y in S4), machining the following workpiece Wn is started (S5). Machining of the following workpiece Wn is controlled in different ways in the case of the idle machining and in the case of the machining (actual machining). In the machining of the following workpiece Wn in the idle machining, position control over the X-axis motor 41*d* is executed on the basis of position information detected by the encoder so as to coincide with the set teed speed of the grinding wheel 43 in the idle machining. The feed speed of the grinding wheel 43 at this time is the same as the feed speed of the grinding wheel 43 in the idle machining of the initial workpiece machining.

Figure 4B:
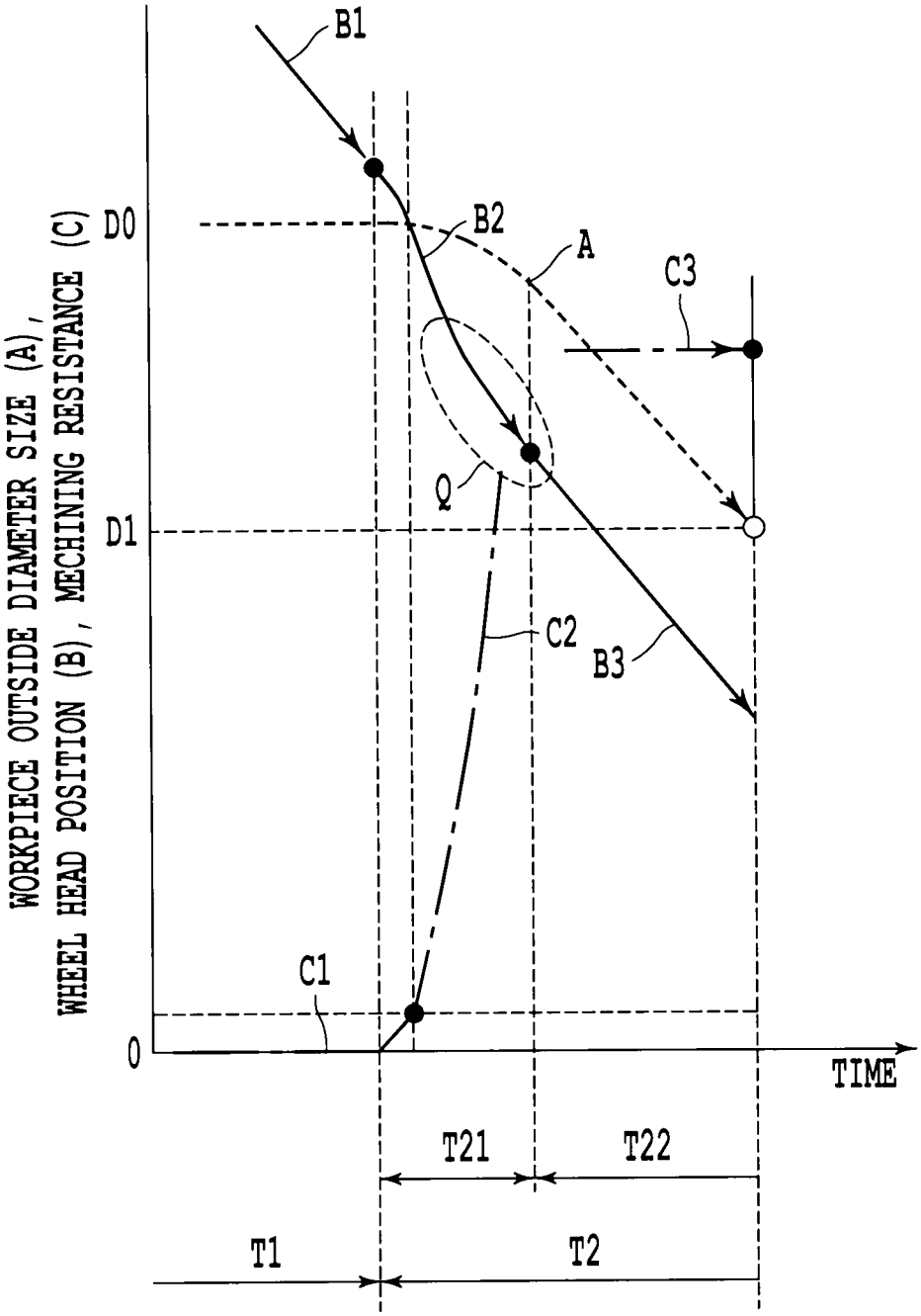
FIG. 4B is a graph that shows a workpiece outside diameter size, a wheel head position and a machining resistance in machining of a following workpiece.

The idle machining is performed in a period indicated by T1 in FIG. 4B. The machining resistance in the idle machining is zero as indicated by C1 in FIG. 4B. In addition, the workpiece outside diameter size at this time is D0 as indicated by A in FIG. 4B. In addition, the behavior of the wheel head position, that is, the feed speed of the grinding wheel 43, at this time has an inclination indicated by B1 in FIG. 4B.

Then, after the end of the idle machining, in machining of the following workpiece Wn in the actual machining, the X-axis motor 41*d* is controlled on the basis of the machining resistance detected by the force sensor 50 so as to reach the steady target machining resistance Rt stored in the target machining resistance setting unit 71. That is, feedback control using the machining resistance is executed over the following workpiece Wn. Then, the feed speed of the grinding wheel 43 in the X-axis direction is controlled through resistance control for the following workpiece Wn.

Specifically, machining in the transitional state is performed in a period indicated by T21 in FIG. 4B. The machining resistance in the transitional state steeply increases as indicated by C2 in FIG. 4B. In the last period of the transitional state, the amount of increase in the machining resistance varies so as to gradually reduce. The workpiece outside diameter size gradually reduces as indicated by A in FIG. 4B. In addition, the behavior of the wheel head position, that is, the feed speed of the grinding wheel 43, at this time becomes faster in the middle of the transitional state than in the initial period of the transitional state and then gradually decreases toward its last period as indicated by B2 in FIG. 4B. That is, the feed speed of the grinding wheel 43 in the transitional state behaves so as to draw a gentle S curve. The gain of feedback control is set such that the feed speed of the grinding wheel 43 in the transitional state behaves as described above.

Then, after the end of the transitional state, as it reaches the steady state (period T22), the machining resistance is constant as indicated by C3 in FIG. 4B. The workpiece outer size of the steady state reduces at a constant rate as indicated by A in FIG. 413. In addition, the behavior of the wheel head position, that is, the feed speed of the grinding wheel 43, in the steady state is constant as indicated by B3 in FIG. 4B.

That is, resistance control is executed such that the feed speed of the grinding wheel 43 in the transitional state is faster than the feed speed of the grinding wheel 43 in the steady state. Furthermore, in transition from the transitional state to the steady state, resistance control is executed such that the feed speed of the grinding wheel 43 smoothly varies.

Referring back to FIG. 3, description will be continued. After machining the following workpiece Wn is started (S5), first, the current outside diameter reduction amount Dn is measured. The outside diameter reduction amount Dn is measured by the sizing device 60. Specifically, the outside diameter reduction amount Dn per unit time in the steady state is measured. Then, the difference ΔD between the currently measured outside diameter reduction amount Dn per unit time and the outside diameter reduction amount D1 per unit time in the steady state in the initial workpiece machining (which corresponds to "target reduction amount" according to the invention) is calculated. Then, it is determined whether the difference ΔD in outside diameter reduction amount falls within a preset permissible value (S6).

Then, when the difference ΔD in outside diameter reduction amount does not fall within the permissible value (N in S6), the steady target machining resistance Rt is corrected (S7). Correcting the steady target machining resistance Rt is performed as follows. First, a value obtained by dividing the current outside diameter reduction amount Dn per unit time by the outside diameter reduction amount D1 per unit time in the initial workpiece machining is multiplied by the steady target machining resistance Rt. Then, the obtained value is set as a new steady target machining resistance Rt. The corrected steady target machining resistance Rt is set in the target machining resistance setting unit 71 as the new steady target machining resistance Rt.

On the other hand, when the difference ΔD in outside diameter reduction amount falls within the permissible value (Y in S6) or after the steady target machining resistance is corrected in step S7, it is determined whether there is the next workpiece W (S8). Then, when there is the next workpiece W (Y in S8), the process returns to step S5 and repeats the process. On the other hand, when there is no next workpiece W (N in S8), the process ends.

Here, in the present embodiment, FIG. 4B shows the workpiece outer size, the wheel head position and the machining resistance in the idle machining, in the transitional state of the actual machining and in the steady state of the actual machining at the time of machining the following workpiece Wn. According to the present embodiment, the feed speed of the grinding wheel 43 in the radial direction with respect to the workpiece W in the transitional state of the following workpiece Wn is controlled so as to be faster than the feed speed of the grinding wheel 43 in the steady state. That is, immediately after the start of machining of the following workpiece Wn (immediately after a transition from the idle machining to the actual machining), the feed speed of the grinding wheel 43 is controlled so as to be faster than the feed speed in the steady state to thereby make it possible to reduce the machining time of the following workpiece Wn in the transitional state.

In addition, in the present embodiment, the machining resistance in the steady state at the time when a workpiece W of the same type has been machined before is set as the steady target machining resistance Rt, and the machining resistance of the currently machining workpiece W in the transitional state is subjected to feedback control so as to reach the steady target machining resistance Rt. In this way, information at the time of the previous machining is utilized. Here, by the time when the machining resistance in the steady state is reached, it is presumable that there is no problem in terms of machining accuracy and machining burn. Thus, in the currently machining transitional state, the feed speed of the grinding wheel 43 is controlled so as to reach the steady target machining resistance Rt to thereby make it possible to suppress occurrence of a problem of machining accuracy or machining burn.

In addition, as indicated by Q in FIG. 4B, in the transitional state, the feed speed of the grinding wheel 43 is controlled so as not to be constant but to be appropriately varied. As the feed speed of the grinding wheel 43 is steeply varied in the last period of the transitional state, that is, around the point of transition from the transitional state to the steady state, there is a possibility that the actual machining resistance exceeds the steady target machining resistance Rt. Then, in some cases, there is a possibility that a problem of machining accuracy or machining burn occurs. Then, as indicated by B2 in FIG. 4B, the feed speed of the grinding wheel 43 is controlled so as to be fast from the initial period to the middle of the transitional state, and the feed speed of the grinding wheel 43 is controlled so as to gradually decrease around the last period of the transitional state. That is, at the time of the transition from the transitional state to the steady state, it is possible to suppress a steep variation in the feed speed of the grinding wheel 43. As a result, it is possible to suppress occurrence of a problem of machining accuracy or machining burn.

Furthermore, in the present embodiment, the steady target machining resistance Rt is corrected on the basis of the outside diameter reduction amounts D1 and Dn of the workpieces. Here, the machining resistance varies because of a variation in sharpness of a tool (grinding wheel, or the like), or the like. In this case as well, the steady target machining resistance Rt is corrected as in the case of the present embodiment to thereby make it possible to set an appropriate steady target machining resistance Rt.

Other Embodiments

In the above embodiment, the control unit 72 executes resistance control over the following workpiece Wn at the time of machining. Other than the above, the control unit 72 may be configured to execute position control over the following workpiece Wn not only in the idle machining but also in the actual machining. In this case, first, the wheel head position (B1, B2 and B3) that gives the behavior of the machining resistance (C1, C2 and C3) of FIG. 4B is calculated on the basis of information obtained at the time of machining the initial workpiece W1. The calculated wheel head position becomes a command value in position control. Then, the control unit 72 executes position control over the X-axis motor 41*d* so as to be positioned at the calculated wheel head position (B1, B2 and 133). That is, the feed speed of the grinding wheel 43 is directly controlled.

Thus, the control unit 72 controls the feed speed of the grinding wheel 43 in the transitional state so as to be faster than the feed speed of the grinding wheel 43 in the steady state. By so doing, in the present embodiment as well, it is possible to reduce the machining time as in the case of the above described embodiment.

In addition, in this case, when the above position control is executed with a decrease in sharpness of the grinding wheel 43, the machining resistance may decrease. In such a case, it is only necessary that the wheel head position is corrected such that the machining resistance in the steady state is detected by the force sensor 50 during machining of the following workpiece Wn and is brought into coincidence with the machining resistance of the initial workpiece W1 in the steady state. By so doing, even when the machining resistance is decreased, it is possible to appropriately perform machining with a desired machining resistance. That is, it is possible to reliably reduce the machining time.

Note that the force sensor 50 may be provided for the tailstock spindle center 32 instead of the main spindle 22, and a strain gauge may be attached to the tailstock spindle center 32 to thereby detect the machining resistance as the amount of strain of the tailstock spindle center 32. In addition, the force sensor 50 may be provided for both the main spindle 22 and the tailstock spindle center 32. In addition, instead of the force sensor 50, the power of the wheel rotating motor 44 is detected on the basis of a variation in current flowing through the wheel rotating motor 44 to thereby make it possible to detect the machining resistance that occurs as a workpiece W is machined by the grinding wheel 43 with that power.

In addition, the power of the X-axis motor 41*d* is detected on the basis of a variation in current flowing through the X-axis motor 41*d* that drives the wheel head 42 to thereby make it possible to detect the machining resistance that occurs as a workpiece W is machined by the grinding wheel 43 with that power. Note that, in this case, it is desirable that the wheel head 42 is driven not by the X-axis motor 41*d*, which is a rotary motor, and the ball screw 41*c* but by a linear motor because it is possible to further accurately detect the machining resistance.

In addition, machining in the above described embodiment may be applied to rough machining; instead, it may also be applied to finish machining. In addition, in the above embodiment, the case where the outer peripheral surface of the workpiece W is machined in the radial direction is described as an example; however, other than this, it may be similarly applied to the case where the inner peripheral surface is machined in the radial direction.

The invention claimed is:

1. A machine tool comprising:

supporting means that rotatably supports a shaft-like workpiece;

a tool that is relatively movable in a radial direction of the workpiece with respect to the supporting means; and control means that relatively moves the supporting means and the tool to machine a peripheral surface of the workpiece in the radial direction, wherein the control means executes control such that a relative feed speed of the tool in the radial direction in a transitional state where an amount of warpage of the workpiece in the radial direction at a machining position increases is faster than a relative feed speed of the tool in the radial direction in a steady state where an amount of warpage of the workpiece in the radial direction at the machining position is constant.

2. The machine tool according to claim 1, wherein the transitional state is a state immediately after a transition from idle machining to machining.

3. The machine tool according to claim 1, further comprising:

machining resistance detecting means that detects a machining resistance that occurs at the time when the workpiece is machined by the tool in actual machining; and target machining resistance setting means that, when the workpiece of the same type has been machined before, sets the machining resistance in a steady state where the amount of warpage of the workpiece in the radial direction is constant as a steady target machining resistance, wherein in the transitional state, the control means controls the feed speed of the tool in the radial direction such that the current machining resistance reaches the target machining resistance.

4. The machine tool according to claim 3, wherein the control means varies the feed speed of the tool in the radial direction in response to the current machining resistance in the transitional state.

5. The machine tool according to claim 3, further comprising:

machining diameter measuring means that measures a machining diameter of the workpiece, wherein at the time of machining the workpiece, the target machining resistance setting means corrects the steady target machining resistance on the basis of the machining diameter of the workpiece, measured by the machining diameter measuring means.

6. The machine tool according to claim 5, wherein when the steady target machining resistance is set, the target machining resistance setting means sets an amount of reduction per unit time of the machining diameter of the workpiece in the steady state, calculated by the machining diameter measuring means in advance, when the current workpiece is machined, the target machining resistance setting means uses the machining diameter measuring means to calculate a current amount of reduction per unit time of the machining diameter of the workpiece in the steady state, the target machining resistance setting means multiplies a value, obtained by dividing the current amount of reduction per unit time of the machining diameter by the set amount of reduction per unit time of the machining diameter, by the steady target machining resistance, and the target machining resistance setting means sets the obtained value as the new steady target machining resistance.

7. A machining method for relatively moving a shaft-like workpiece and a tool in a radial direction of the workpiece while rotating the workpiece to thereby machine a peripheral surface of the workpiece in the radial direction, comprising:

executing control such that a relative feed speed of the tool in the radial direction in a transitional state where an amount of warpage of the workpiece in the radial direction at a machining position increases is faster than a relative feed speed of the tool in the radial direction in a steady state where an amount of warpage of the workpiece in the radial direction at the machining position is constant.

* * * * *